US008201625B2

(12) United States Patent
Almaguer

(10) Patent No.: US 8,201,625 B2
(45) Date of Patent: Jun. 19, 2012

(54) BOREHOLE IMAGING AND ORIENTATION OF DOWNHOLE TOOLS

(75) Inventor: James S. Almaguer, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 206 days.

(21) Appl. No.: 11/964,145

(22) Filed: Dec. 26, 2007

(65) Prior Publication Data

US 2009/0166035 A1 Jul. 2, 2009

(51) Int. Cl.
*E21B 47/10* (2012.01)

(52) U.S. Cl. ..... 166/250.08; 166/255.2

(58) Field of Classification Search ..... 166/255.2, 166/240, 384, 383, 330, 320, 321, 250.08; 175/4.51; 181/105
See application file for complete search history.

(56) References Cited

U.S. PATENT DOCUMENTS

| | | | | | |
|---|---|---|---|---|---|
| 2,356,082 | A | * | 8/1944 | Otis | 175/4.55 |
| 2,383,455 | A | * | 8/1945 | Abadie | 73/152.13 |
| 4,774,573 | A | | 9/1988 | Mount, II et al. | |
| 5,010,964 | A | | 4/1991 | Cornette | |
| 5,353,637 | A | * | 10/1994 | Plumb et al. | 73/152.17 |
| 6,041,860 | A | | 3/2000 | Nazzal et al. | |
| 6,135,205 | A | * | 10/2000 | Phillips | 166/297 |
| 6,173,773 | B1 | * | 1/2001 | Almaguer et al. | 166/255.2 |
| 6,378,607 | B1 | * | 4/2002 | Ryan et al. | 166/255.2 |
| 6,484,818 | B2 | * | 11/2002 | Alft et al. | 175/45 |
| 6,513,591 | B1 | * | 2/2003 | Heijnen | 166/250.08 |
| 7,002,484 | B2 | * | 2/2006 | McElhinney | 340/853.5 |
| 2004/0140091 | A1 | * | 7/2004 | Gupta | 166/254.1 |
| 2004/0238166 | A1 | * | 12/2004 | Salamitou et al. | 166/255.1 |
| 2005/0189946 | A1 | | 9/2005 | Moore | |
| 2005/0269082 | A1 | * | 12/2005 | Baron et al. | 166/255.2 |

FOREIGN PATENT DOCUMENTS

| | | |
|---|---|---|
| WO | WO00/75485 | 12/2000 |
| WO | WO2004074625 | 9/2004 |

* cited by examiner

*Primary Examiner* — Daniel P Stephenson
*Assistant Examiner* — Kipp Wallace
(74) *Attorney, Agent, or Firm* — Shaun B. Sethna; Darla P. Fonseca

(57) ABSTRACT

Methods of generating radial survey images of a borehole and methods of orienting downhole operational tools are disclosed. The disclosed techniques are used to generate a radial survey of the borehole in the form of one or more rose-plots and/or a radial image of the borehole and surrounding area that can be used to properly orient downhole operational tools in the desired direction. The tool string includes, from the top to bottom, a telemetry module, a non-rotating centralizer, a motor module, an imaging sonde used to survey the borehole, a rotating centralizer and a downhole operational tool. The motor module can be used to rotate the imaging sonde to generate the radial survey and then rotate the downhole operational tool to the desired direction based upon a review of the radial survey.

18 Claims, 12 Drawing Sheets

BOREHOLE IMAGING AND ORIENTATION OF DOWNHOLE TOOLS

BACKGROUND

1. Technical Field

Improved methods and downhole tools are disclosed for the imaging of a borehole for the purpose of properly orienting various downhole operational tools within the borehole. Improved logs in the form of rose-plots and cross-sectional images of boreholes are also disclosed.

2. Description of the Related Art

As the price of oil and gas increases and global supplies dwindle, oil and gas well completions are becoming more complex. Specifically, greater efforts are being expended at producing thinner, laminated reservoirs that may not have been produced in the past. Further, older, abandoned reservoirs are being reworked using enhanced oil recovery (EOR) and other techniques to extract as much remaining oil and gas as possible in contrast to past practices where such an older well may have been simply abandoned.

To meet the requirements of today's more complex completions, there is a growing need to survey or log and image the borehole and surrounding formation for the purpose of steering, positioning and orienting tools such as directional logging tools, re-entry tools, pipe cutters, whipstocks, directional flow meters, zero phase perforation guns, core samplers, fluid samplers, etc., in real-time. For example, FIGS. 1A-4 provide just some of the scenarios where a cross-sectional image of a borehole is needed.

Turning first to FIG. 1A, a borehole 10 is "open" or not-cased at the depth shown and includes two production strings or tubing strings 11, 12 that are resting against each other and are cemented in place in the borehole 10 in a decentralized position. A logging tool 13 has been lowered into the tubing 11. For this example, if the tubing 12 is producing adequately, it may be desirable, to perforate through the tubing 11 to the formation 14 without perforating or damaging the production tubing 12. Such a scenario would require proper orientation of a perforating gun lowered into the tubing 11 so that the charges are directed outward towards the formation 14 and away from the tubing 12 as well as away from the center of the borehole 10 which is filled with cement 15. Further, if there are problems associated with the production tubing 12, it may also be desirable to perforate the tubing 12 through the tubing 11 and produce reservoir fluid through the tubing 11 instead of the tubing 12.

The same borehole 10 at a different depth (or a different borehole) is shown in FIG. 1B where the tubing strings 11, 12 are spaced apart and more centered within the borehole 10. Again, it may be desirable to perforate the tubing 12 through the tubing 11 or direct charges towards the formation 14 from the tubing 11 and away from the tubing 12. In either scenario, a downhole image like those presented in FIGS. 1A-1B in real-time would be highly beneficial so that the perforation gun can be properly oriented.

A similar scenario is presented in FIGS. 2A-2B, wherein the section of borehole 10 shown is cased with an outer casing 16, which is cemented in place with the annular cement 17. It may be desirable to perforate the formation 14 through the tubing 11 and casing 16 without damaging the production tubing 12. Also, it may be desirable to perforate the production tubing 12 and produce through the tubing 11 in the event the production tubing 12 is damaged uphole or there are other problems associated with the production tubing 12 causing the well to be shut-in at the surface. On the other hand, it may be desirable to perforate the formation 14 without damaging the tubing 12.

In FIGS. 3A-3B, the borehole 10 is lined with casing 16 and cement 17. A production tubing string 12 and a logging tool 13 are shown. The logging tool 13 may have been lowered through a short production string (not shown at the depth illustrated in FIG. 3A) so that the logging tool 13 is disposed below the short production string or only a single production string 12 has been used as shown in FIG. 3B. Referring to FIG. 3A, proper orientation of the perforating gun is essential to avoid damage to the production tubing 12 and, referring to FIG. 3B, with the production string 12 in a decentralized position, proper orientation of the perforation gun is essential for exploiting the decentralized position of the tubing 12 against the casing 16 and formation 14.

Turning to FIG. 4, an uncased relief borehole 10*a* has been drilled in the vicinity of an older well or borehole 10. To utilize the borehole 10*a* as a relief well, perforations can be used to interconnect the boreholes 10, 10*a*. In such a situation, a borehole image, similar to the one shown in FIG. 4, is essential for properly orienting a perforation gun to ensure that shaped charges can traverse the formation 14*a* disposed between the boreholes 10*a*, 10.

In FIG. 5A, a borehole 10 is lined with casing 16 that is cemented in place as shown by the annular cement 17. A production tubing 12 is disposed within the casing 16*b* and includes a submersible pump cable 21 strapped to the outside diameter of the tubing 12 and held in place by a clamp assembly 22. If the borehole 10 is to be perforated, it is imperative that the perforating guns be directed away from the pump cable 21 and clamp assembly 22. Similarly, referring to FIG. 5B, the casing 16 may be equipped with a control cable or censor cable 23 that is held in place with a clamp assembly 22*a*. Obviously, perforation of the borehole 10 at the depth shown in FIG. 5B is must be carried out so that the sensor cable 23 is not damaged.

While all the above specific examples are directed primarily towards perforating, there is a need for improved techniques and tools for real-time borehole imaging and subsequent orientation of downhole operational tools and instruments including, but not limited to segment cutters, split-shots, chemical cutters, shot-sticks, reentry noses, punchers, core guns, whipstocks, directional flowmeters, pressure, temperature fluid samplers, and the like.

Thus, with today's complex well completions, there is a growing need for surveys and images of the borehole and immediate surroundings for the purpose of steering, positioning and orienting downhole operational tools in real-time. Such borehole imaging also has applications extending outside the oil & gas industry, such as surveying wells for river crossings or surveying subterranean tunnels or storage caverns.

SUMMARY OF THE DISCLOSURE

The tools and methods disclosed herein, along with surface data processors, address the aforenoted needs in a practical way. Methods of generating radial survey images of a borehole and methods of orienting downhole operational tools are disclosed. The processing of real-time data may include correlation with pre-established tool responses cataloged in one or more databases. These databases may contain carefully established tool response in a multitude of "standard" configurations. The data for each configuration may then be used for correcting, curve matching and correlating tool response. The disclosed techniques and principles are used to generate a radial survey of the borehole in the form of one or more rose-plots and/or a radial image of the borehole and surrounding area that can be used to properly orient downhole operational tools in the desired direction.

The data collected downhole used in generating the radial surveys can be conveyed via wireline, coiled tubing, rigid pipe (tough logging condition (TLC) or logging while drilling (LWD)), and electric slickline or non-electric slickline with battery power and memory record (log) mode.

The disclosed radial logging techniques may be used to radially orient a wide variety of downhole operational tools including, but not limited to: whipstocks for side-track drilling or re-entry; directional pipe cutters and radial pipe cutters to facilitate sidetrack drilling through drill pipe, casing or tubing; segmented cutters for cutting a window or opening in drill pipe, casing or tubing; re-entry tools; directional flow meters; directional temperature probes; perforating guns such as 0° phased or 180° phased guns; core guns; pressure, temperature, pressure and fluid samplers or test tools; focused nuclear tools that can measure direction of flow of an injected radioactive tracer; stuck-point indicators for determining location of stuck drill pipe or other equipment; inspection and/or verification of perforations; and detection of moving parts including using df/dt or Doppler-shift; articulating and non-articulating reentry noses used for assisting in re-entry into a side track or a desired lateral well; a focused video camera sonde that may include a video camera, illumination source and infrared sensors for detecting thermal sources or thermal changes around the borehole.

In one embodiment, a tool string with one or more downhole operational tools and a means to orient those tools includes a telemetry module. A telemetry module provides real-time, high-speed communication between downhole instruments and surface instrumentation. The telemetry module receives, interprets and executes commands sent from surface and communicates data bi-directionally using one or more cable communication schemes known to those skilled in the art.

The tool string also preferably includes a non-rotating type centralizer disposed above a motor module. The non-rotating centralizer provides centralization to the string as necessary for measurement performance and radial anchoring when a motorized module is used for rotating the string.

The motorized module utilizes the stationary force of the centralizer arms to rotate the portion of the tool string below the non-rotating centralizer. The motor module uses a motorized mechanism to rotate the portion of the string disposed below the motor module as specified by the operator via the surface instrumentation. The motor module can be controlled for speed, direction, torque, continuous mode rotation or indexed (e.g., servo), etc.

The tool string also includes one or more imaging devices, which may include one or more combinable sub-sections or modules, including, but not limited to: a focused electromagnetic or induction sonde, e.g., eddy current and remote field eddy current induction tool; a focused nuclear sonde for detection of natural gamma-rays, a radioactive source planted in an adjacent well or a well component, or a radioactive tracer fluid; a focused nuclear-based elemental spectroscopy sonde; a focused acoustic sonde, e.g., sub-sonic sonic, ultrasonic, etc.

The tool string may also include one or more orienting devices including, but not limited to: a focused magnetic device or one or more magnetometer-based sensors; an inclinometer for measuring wellbore inclination and relative bearing or the angle between high-side of well and the tool's reference point or tool-face; a gyroscope, such as a mechanical, solid-state or MEMS (micro-electro-mechanical systems) gyroscope for azimuth or true-north determination; and focused flowmeters for determining direction of flow for diagnostic purposes or for future well planning (e.g., permeability anisotropy).

Numerous measurements are made in real-time by the above modules, devices or sondes. Such measurements can be used by the surface instrumentation to generate a cross-sectional image of the condition of the pipe or pipes and their relative configuration or orientation. In such an embodiment, focused sensors make measurements and generate data as the module is rotated about the longitudinal axis of the tool string. The initial scan or sweeping radial image can include amplitude or intensity versus radial degrees rotated or versus azimuth or versus relative bearing, or versus time. At the surface, a graphical image is generated as the tool rotates that similar to a radar scan. Other formats may be presented as will be apparent to those skilled in the art.

A rotating type centralizer may be used below the motor module that allows the imaging modules and operational downhole devices to rotate. The rotating type centralizer therefore provides centralization, while transferring torque.

The above may be performed with many variations. For example, the string may be run with only one centralizer, or it may be run with de-centralizers instead of centralizers.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiments illustrated in greater detail in the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION OF THE PRESENTLY PREFERRED EMBODIMENTS

The radial surveying and imaging the borehole, which may include the detection of well components near the tool (e.g., see FIGS. 1A-5B) may be accomplished using one or more of the principles discussed herein. These principles may be implemented in a single tool or they may be implemented via a combination of "modularized" tools to provide cumulative functions.

Orienting tools used with perforating guns in vertical or deviated boreholes are disclosed in the commonly assigned U.S. Pat. Nos. 6,173,773 and 6,378,607, which are incorporated herein by reference. Additional methods for orienting guns or other downhole operational tools are disclosed below. The terms "downhole operational tool" or "downhole operational device" will refer generically to a downhole tool that could require radial orientation by way of a motor module that rotates the part of the tool string that includes the downhole operational tool. Such downhole operational tools include, but are not limited to: whipstocks for side-track drilling or re-entry; directional pipe cutters and radial pipe cutters to facilitate sidetrack drilling through drill pipe, casing or tubing; segmented cutters for cutting a window or opening in drill pipe, casing or tubing; re-entry tools; directional flow meters; directional temperature probes; perforating guns such as 0° phased or 180° phased guns; core guns; pressure, temperature, pressure and fluid samplers or test tools; focused nuclear tools that can measure direction of flow of an injected radioactive tracer; stuck-point indicators for determining location of stuck drill pipe or other equipment; inspection and/or verification of perforations; and detection of moving parts including using df/dt or Doppler-shift; articulating and non-articulating reentry noses used for assisting in re-entry into a side track or a desired lateral well; a focused video camera sonde that may include a video camera, illumination source and infrared sensors for detecting thermal sources or thermal changes around the borehole.

Figure 6:
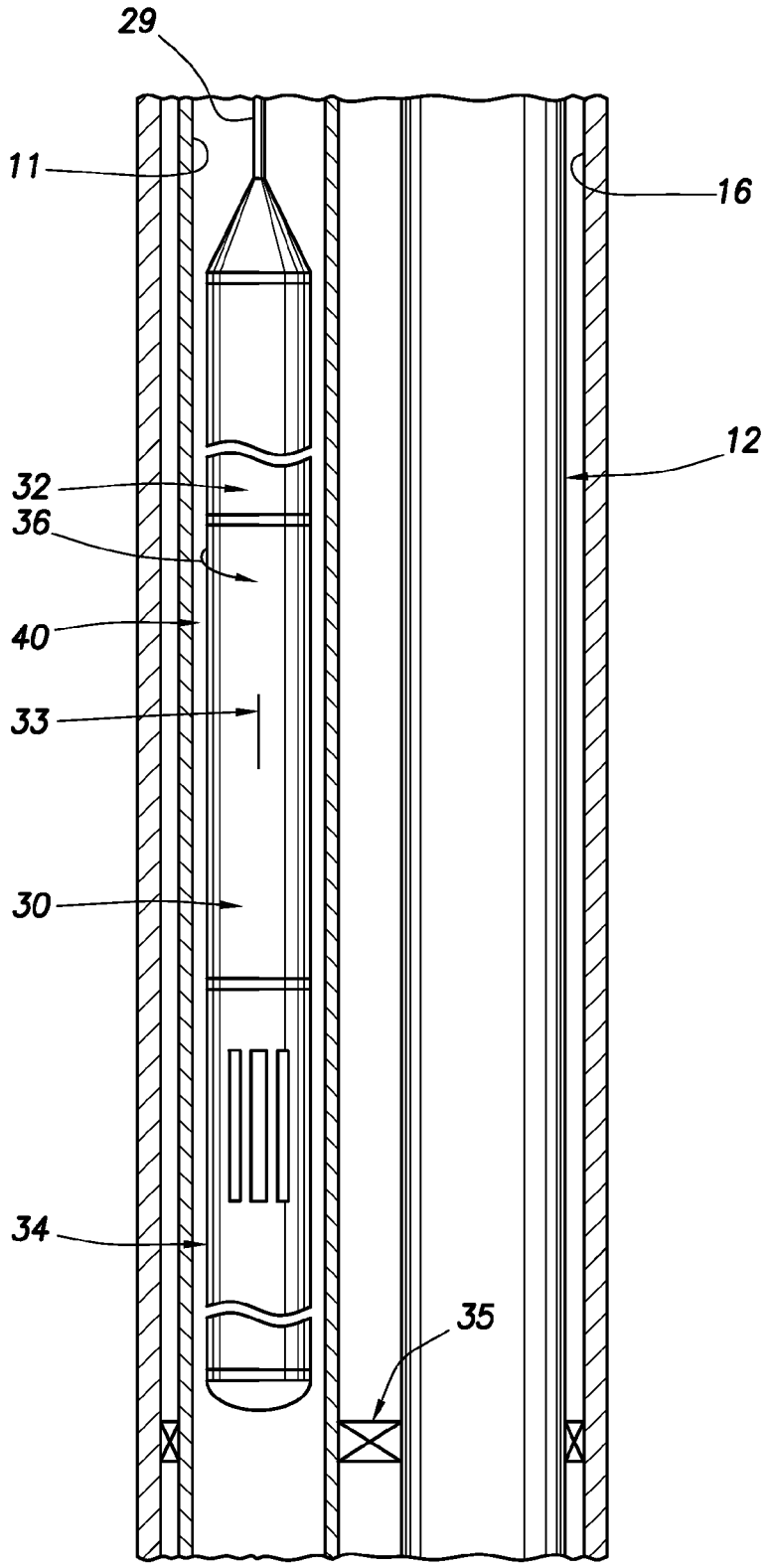
FIG. 6 is a sectional view of a cased well with two tubing strings, held in place by a production packer and an imaging logging tool disposed within one of the tubing strings.

FIG. 6 shows a dual completion well with an outer casing 16 and two tubing strings 11, 12. A tool string 40 has been lowered down the tubing string 11 via a wireline 29. The tool string may include centralizers and anti-rotation devices disposed above a motor module 32 and at least one imaging sonde or module 30 disposed below the motor module 32. A reference mark on the imaging module 30 is shown at 33. One or more downhole operational tools as discussed above are shown generically at 34 and a production packer is shown at 35. By rotating the portion of the tool string 40 disposed below the motor module 32 as indicated by the arrow 36, the imaging sonde 30 can be rotated to produce a radial survey as shown in FIGS. 14-19 and discussed in greater detail below. Also, once the well is surveyed, the downhole operational tool 34 can be rotated to the desired radial orientation or direction. For example, a 0° perforation gun can be rotated so the charges are directed away from the tubing 12 and towards the formation or a tubing puncher could be rotated towards the tubing 12, depending upon the particular operation being carried out.

Figure 8:
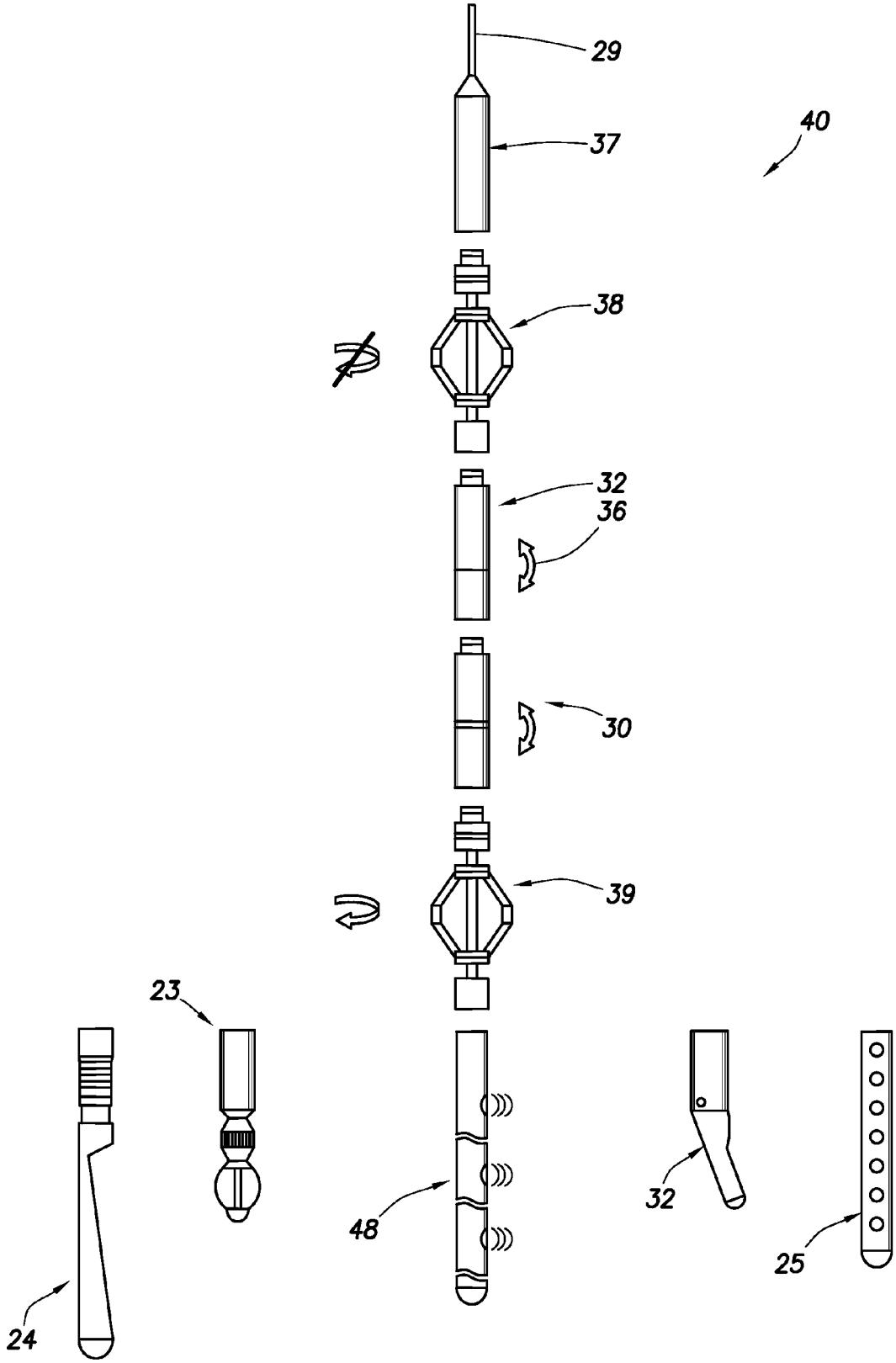
FIG. 8 is an exploded view of various tool string combinations in accordance with this disclosure.

FIG. 8 illustrates just some of the possibilities for a tool string 40 that is connected to a wireline 29 by the logging head and telemetry module 37. The telemetry module 37 is preferably connected to a non-rotating centralizer 38 which, in turn, is connected to the motor module 32. The non-rotating centralizer 38 prevents torque from being applied to the logging head and telemetry module 37 and a wireline 29 while the motor module 32 rotates the lower components of the tool string 40 in either direction as indicated by the double arrow 36. The motor module 32 may be connected to one or more imaging modules 30 selected from the group consisting of: a focused electro-magnetic sonde or eddy current and remote field eddy current induction tool 31 as discussed below the connection with FIG. 10; a focused nuclear tool; a focused acoustic tool; and combinations thereof. A rotating-type centralizer 39 may be disposed below the imaging sonde 30 and above the downhole operational tools which may be selected from the group consisting of: a whipstock 24; a cutting device, split-shot or shot-stick, shown generally a 23; an additional logging or imaging tool such as a focused acoustic a sonde, a focused flowmeter sonde, a focused pressure and/or temperature sonde, a focused electromagnetic sonde, an infrared imaging device, shown generally at 48; a reentry nose or device, shown generally 32; a perforation gun, puncher, core sample taker or fluid sampler shown generally at 25; and combinations of the above.

Magnetometer Sondes

Figure 9:
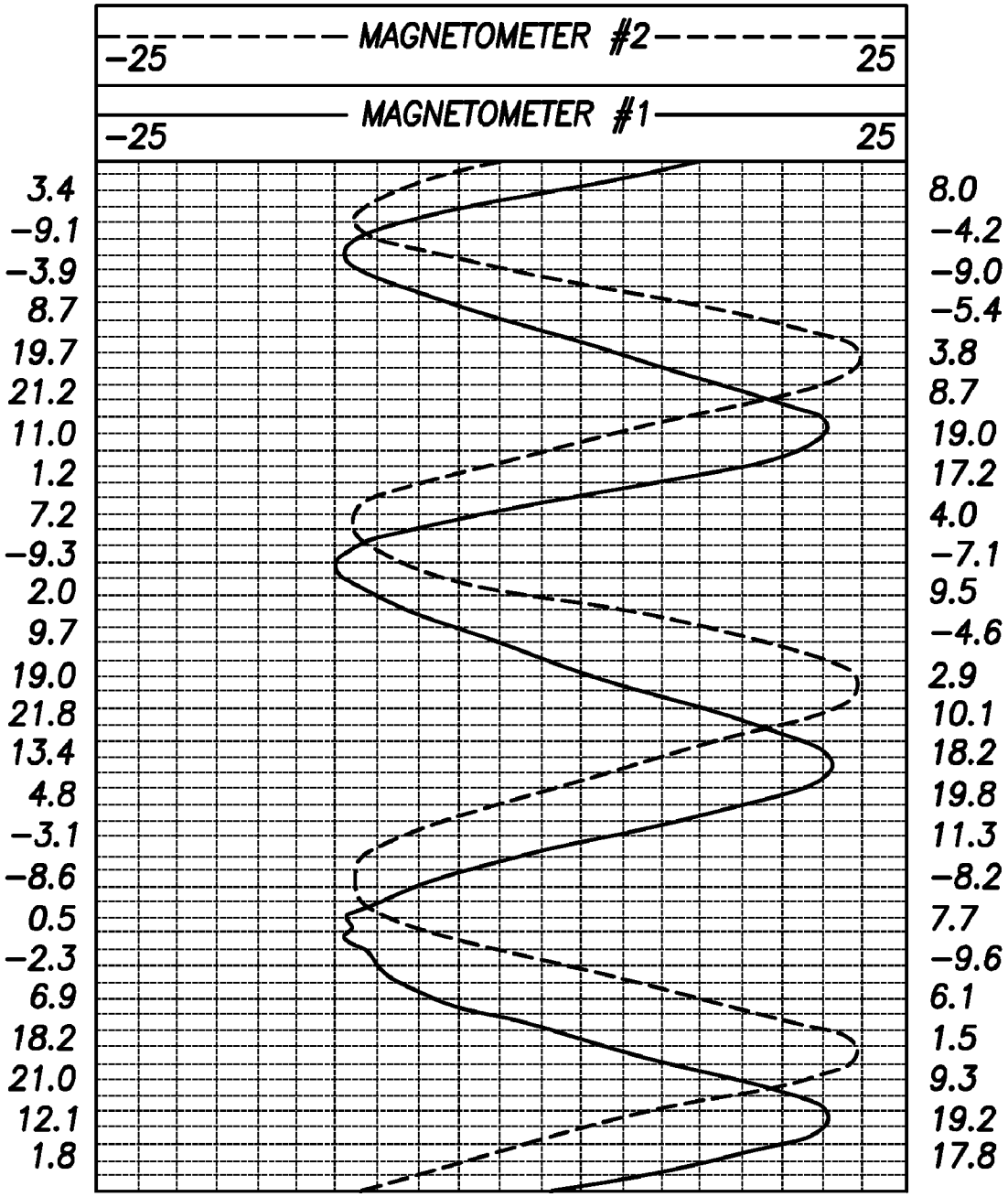
FIG. 9 is a stationary log produced by a magnetometer tool rotating 360° at about 0.75 rpm with dual sensors including a y-axis oriented sensor and an x-axis oriented sensor wherein the horizontal axis is counts or frequency and the vertical axis is time.

If a relative bearing (RB) cannot be obtained, a magnetic log can be obtained as shown in FIG. 9 using a magnetometer or magnetic sonde. It is known from empirical data that the natural magnetism around the pipe in a given well and given depth varies uniquely. That is, the magnetic intensity and polarity varies as measured radially at any given depth and there is magnetic anisotropy around a borehole as shown in FIG. 9, which is an actual log of a Southeast Texas cased well at approximately 6,000 feet displaying such magnetic anisotropy. The log of FIG. 9 was taken with magnetometer tool rotated about a longitudinal axis of the tool string.

It is therefore possible to use the unique magnetic anisotropy of a borehole as illustrated by the example of FIG. 9 to confirm the orientation or radial position of tools. In one technique, as illustrated in U.S. Pat. No. 6,173,773, the first trip in the well may include a gyroscope in the tool string. The gyroscope can measure the tool-face azimuth (i.e., direction that the tool reference point is facing with respect to geographic north or true north). The magnetic anisotropy as well as other parameters such as relative bearing (RB) can be surveyed with the azimuthal measurement. A correlation between the gyroscope and magnetic surveys can be established and the magnetic anisotropy, and any other measurements, can be mapped to azimuth. On the perforating trip, the gyroscope is preferably excluded and the tool string can be oriented with respect to azimuth using the previously established correlation map and the current magnetic survey. Because the gyroscope is an expensive and delicate instrument, it is desirable to avoid the risk of damaging it by the high shock associated with explosive perforating. Multiple intervals can be surveyed on the same trip. These intervals can be subsequently perforated on another single trip (e.g., using selective perforating), or on separate trips. Alternatively, as MEMS-based gyroscopes become available, it is anticipated that these devices will be able to withstand the shock of perforating and therefore the gyroscope can remain in the tool string and be used as an orientating device in single trip operations.

In addition, another strategy involves the attachment of a magnetic source to an outer or inner surface of the casing or tubing prior to installation in the borehole in the desired orientation for a particular subsequent operation. The magnetometer can then be used to detect the magnetic source and its radial direction, and thereby orient devices accordingly. When it is important to avoid perforating in the direction of other well components (e.g., another completion string, pump cable, sensor cable, injection tube, etc), the magnetic source can be placed in alignment with the well component to be missed. The magnetometer can then be used to detect the magnetic source and to orient the perforators the opposite direction.

In a dual completion as shown in FIGS. 2A-3B, when the magnetic source is not installed prior to running the casing 16, the magnetic source may be lowered into the tubing 12. The planted magnetic source can be used as the "reference" magnetic source to accomplish the orientation of the logging tool 13 or establish the spatial relationship between two tubing strings 11, 12. The magnetic source may be a simple permanent magnet in a non-magnetic housing (e.g., a casing collar locator (CCL)). For cost and operational effectiveness, the magnetic source may be conveyed using a slickline. The magnetic source may alternatively be electromagnetic (e.g., a coil) which can be controlled from the surface for better confirmation.

Figure 5A:
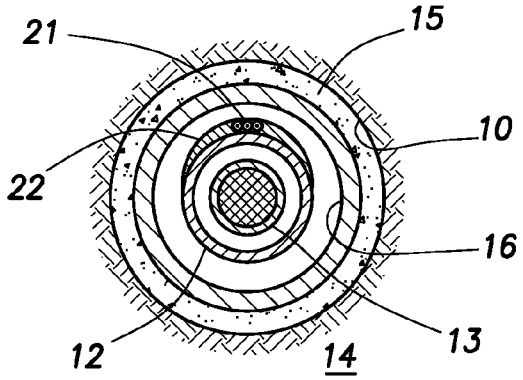
FIG. 5A is a sectional view of a cased and cemented borehole with one production tubing string disposed therein in a centralized position with a submersible pump cable and clamp assembly attached to the tubing string and a logging instrument disposed within the tubing string.
Figure 5B:
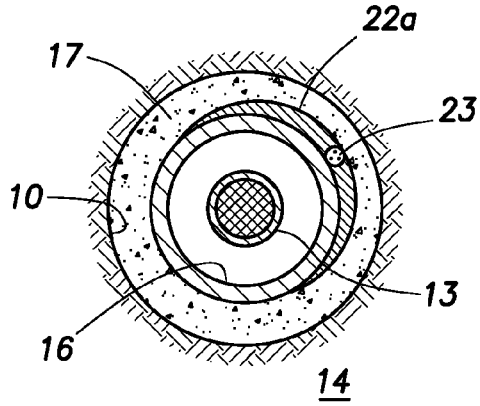
FIG. 5B is a sectional view of a cased and cemented borehole with a sensor cable attached to the casing by a clamp assembly and a logging instrument disposed within the casing.

Often, pumps and associated cables are disposed in wells. Because of the focus of a magnetometer sensor and its high sensitivity to magnetic fields, it is possible to detect the radial direction of pump cables 22 via the magnetic field generated in the cable and protect the cable 22 by orienting guns away from them as shown in FIG. 5A. This is particularly feasible when the armored jacket of the pump cable has low magnetic permeability, and the tubing or casing likewise has low magnetic permeability. Even in the case where the operating frequency of the pump is low enough to be used (e.g., 60-Hz), however, it is possible to apply a lower frequency to the pump for a short period for the purpose of finding the orientation of the cables 22. As shown in FIG. 5B, the same techniques can be applied to a control or sensor cable 22*a*.

Because a magnetometer-based tool can determine its azimuthal orientation in an open or uncased borehole, a magnetometer can orient a multitude of devices with respect to magnetic north. For example, core guns and pressure, temperature and/or fluid samplers can be oriented azimuthally. Azimuth data can be useful in designing completion and stimulation treatment. Determining the preferential fracture plan for example, is highly beneficial for optimizing hydraulic fracture treatments when combined with oriented perforating.

The magnetic sensor or magnetometer may be based on a variety of sensor technologies such as Hall Effect sensors, silicon based sensors (e.g., anisotropic magneto resistive (AMR), giant magneto resistive (GMR)), superconducting quantum interference device (SQUID), search-coil, magnetic flux-gate, magneto inductive, and others. Because of their excellent sensitivity (40μ gauss) and high temperature rating (225° C.), the magneto-resistive type devices are particularly useful.

The magnetometer should be normally focused, having an axis with maximum sensitivity. For additional focus, shielding can be provided on the "back-side" with material having high magnetic permeability. In one embodiment, the magnetometers are arranged for bi-axial and tri-axial coverage. This allows cross-referencing and gives the opportunity for complete composition. A number of algorithms can be used for treating the measured data, and to optimize the presentation of radial magnetic survey. For example, the measurements may be linearly computed, with linear gain amplification, or the data may be filtered or processed with other algorithms, ratios, or statistical analysis.

Figure 1A:
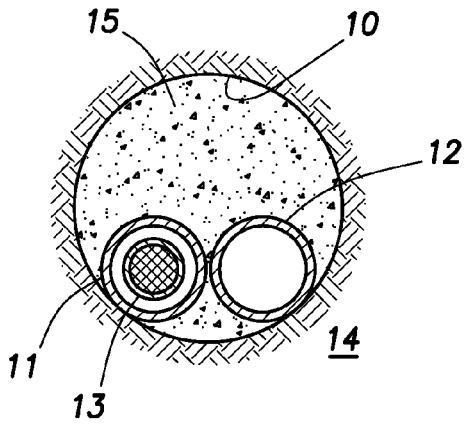
FIG. 1A is a sectional view of an uncased borehole with two tubing strings cemented therein in a decentralized position and a logging instrument disposed within one of the tubing strings.
Figure 1B:
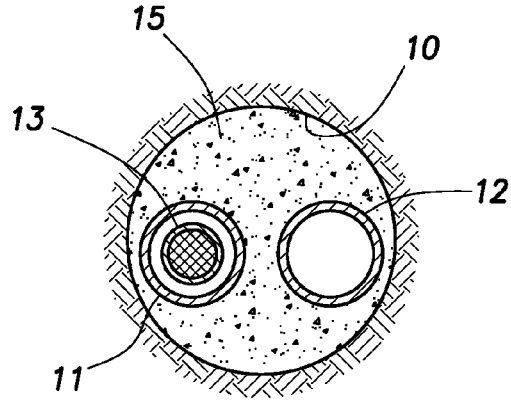
FIG. 1B is a sectional view of an uncased borehole with two tubing strings cemented therein in a somewhat centralized position and a logging instrument disposed within one of the tubing strings.
Figure 2A:
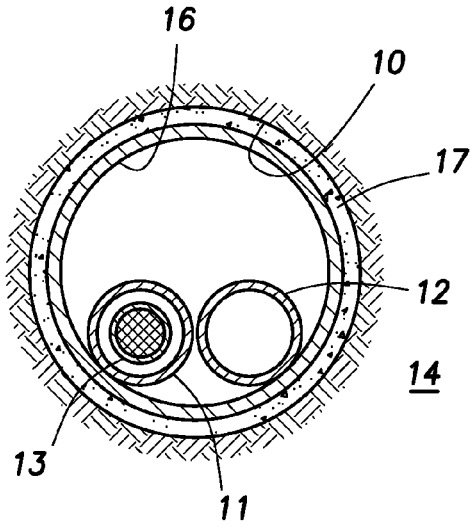
FIG. 2A is a sectional view of a cased and cemented borehole with two tubing strings disposed therein in a decentralized position and a logging instrument disposed within one of the tubing strings.
Figure 2B:
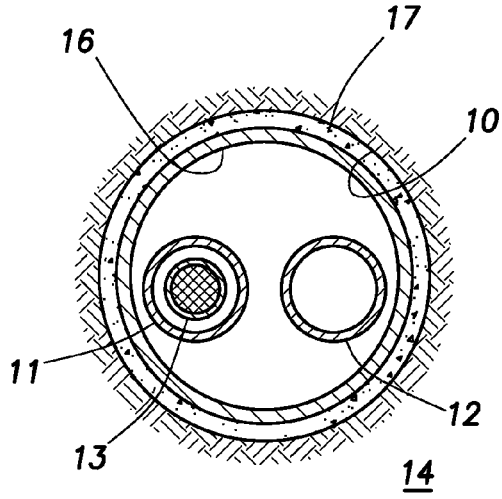
FIG. 2B is a sectional view of a cased and cemented borehole with two tubing strings disposed therein in a generally centralized position and a logging instrument disposed within one of the tubing strings.
Figure 3A:
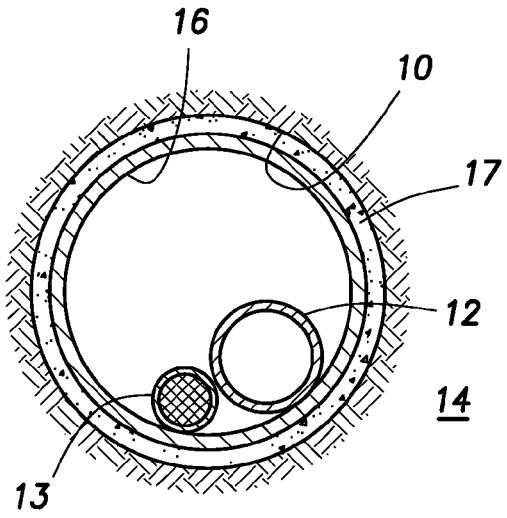
FIG. 3A is a sectional view of a cased and cemented borehole with one production tubing string disposed therein in a decentralized position and a logging instrument disposed adjacent to the production tubing, also in a decentralized position.
Figure 3B:
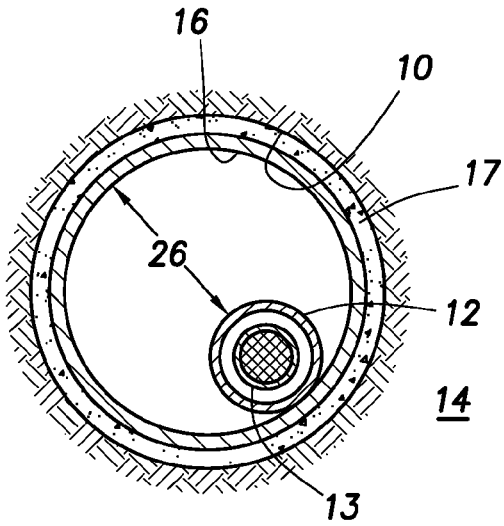
FIG. 3B is a sectional view of a cased and cemented borehole with one production tubing string disposed therein in a decentralized position and a logging instrument disposed within the decentralized production tubing.
Figure 4:
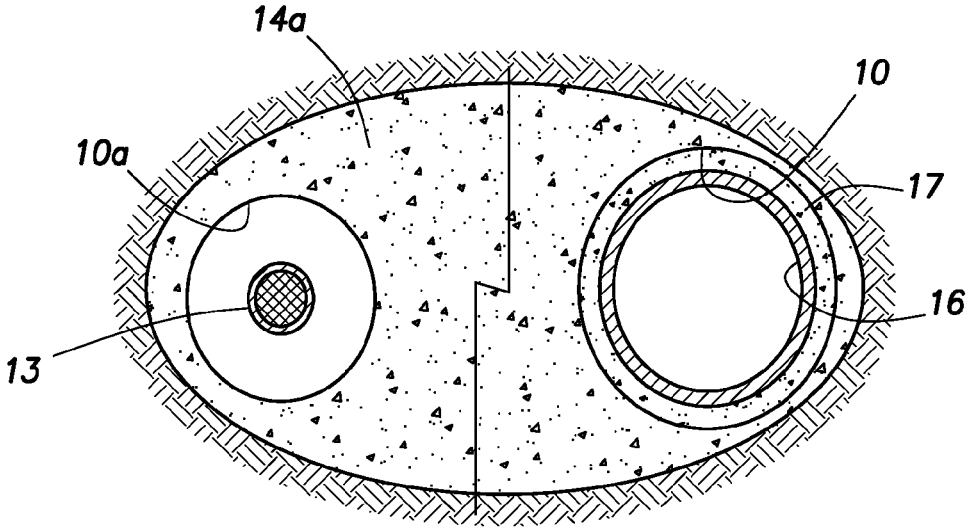
FIG. 4 is a sectional view of a completed and cased well and an adjacent uncased relief well.

As shown in FIGS. 1A-7B, a magnetometer or other imaging device may be used to detect the presence and radial direction of components in and outside the borehole for the purpose of orienting devices away from or towards them. These components may include but not limited to an adjacent tubing completion 12 (FIGS. 1A-3A, 5A-6 and 7B), cables or sensors 22, 22*a* (FIGS. 5A-5B), and adjacent wells with casing 16 (FIG. 4). In an open borehole 10*a*, a magnetometer tool may be used to locate or indicate the radial direction of a cased well nearby.

One technique involves the perforation of the nearby well 10 from the relief well 10*a* for well control (FIG. 4). A perforating gun 13 would be lowered in the newly drilled relief well 10*a* and an imaging tool would allow the directional perforating gun to be rotated towards the out of control producing well 10. Once the wells 10, 10*a* are hydraulically linked, heavy mud or fluid can be pumped into the producing well 10 via the relief well 10*a* to create a hydrostatic head and thus kill or control the producing well 10.

In certain applications, it is critical to determine the proximity (distance) to adjacent tubing strings or to casing when inside tubing string for the purpose of orienting devices (e.g., whipstocks). For example, referring to FIG. 3B, to facilitate sidetrack drilling through the side of tubing 12 and outer casing 16, especially if the tubing 12 is coiled tubing, it is preferred to orient the cutter 23 (FIG. 8) and thus the window in the direction closest to the outer casing 16. Otherwise, there is a risk that the milling operation does not penetrate the outer casing 16 but instead ricochets off (because of the distance and the resulting flexure in the tubing 12). To avoid this problem, the whipstock 24 (FIG. 8) must be oriented and set in the direction where the tubing 12 is closest to the casing 16.

Still referring to FIG. 3B, in some cases it be critical to orient a perforator 25 (FIG. 8) in the direction closest to the casing 16 in order to maximize the penetration. Cross-casing shots will have the shallowest penetration due to the large stand-off and the amount of liquid in this gap. This is particularly critical with small diameter guns.

Still referring to FIG. 3B, in other applications, it is important to orient shots in the opposite direction or furthest away from the casing 16. One such application is in shooting special "puncher" charges for the purpose of displacing hydrocarbons from the bottom up prior to pulling the completion. In such a case, it is important to "punch" or perforate only the tubing 12 and not the casing 13. Orienting the shots towards the largest tubing-casing standoff 26 reduces the risk of unwanted damage to the casing 16. Likewise when making a "split-shot" (axial line cutter) for pipe recovery. In order to avoid damage to the casing 16, it is important to orient the cutter 23 towards the largest clearance 26 between tubing 12 and casing 16 as illustrated schematically in FIG. 3B.

Electro-Magnetic or Induction Sondes

Figure 7A:
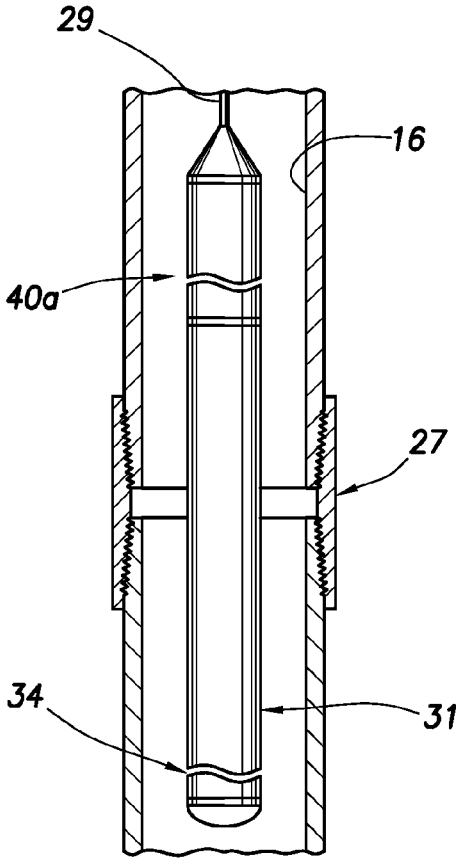
FIG. 7A is a sectional view of a casing coupling or collar with a logging tool disclosed therein.
Figure 7B:
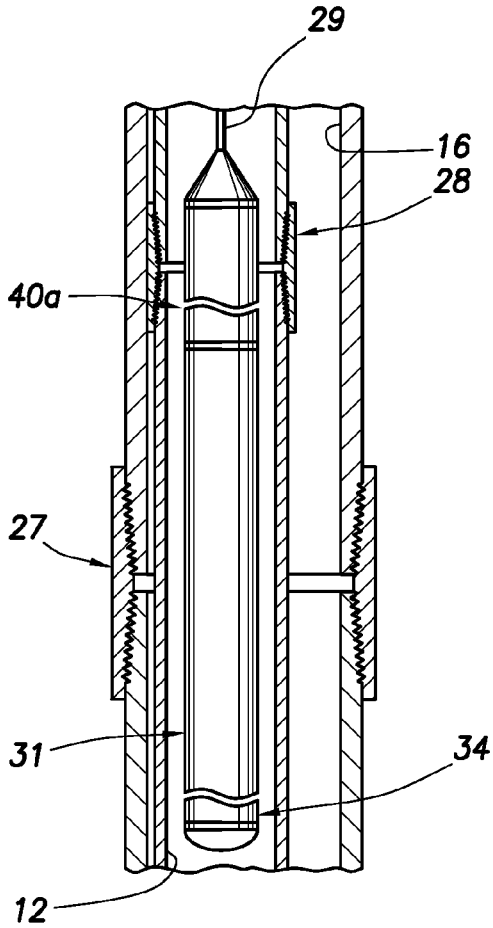
FIG. 7B is a sectional view of a casing coupling or collar and a production tubing disposed within the casing and that includes a coupling or collar with a logging tool disposed within the tubing.
Figure 10:
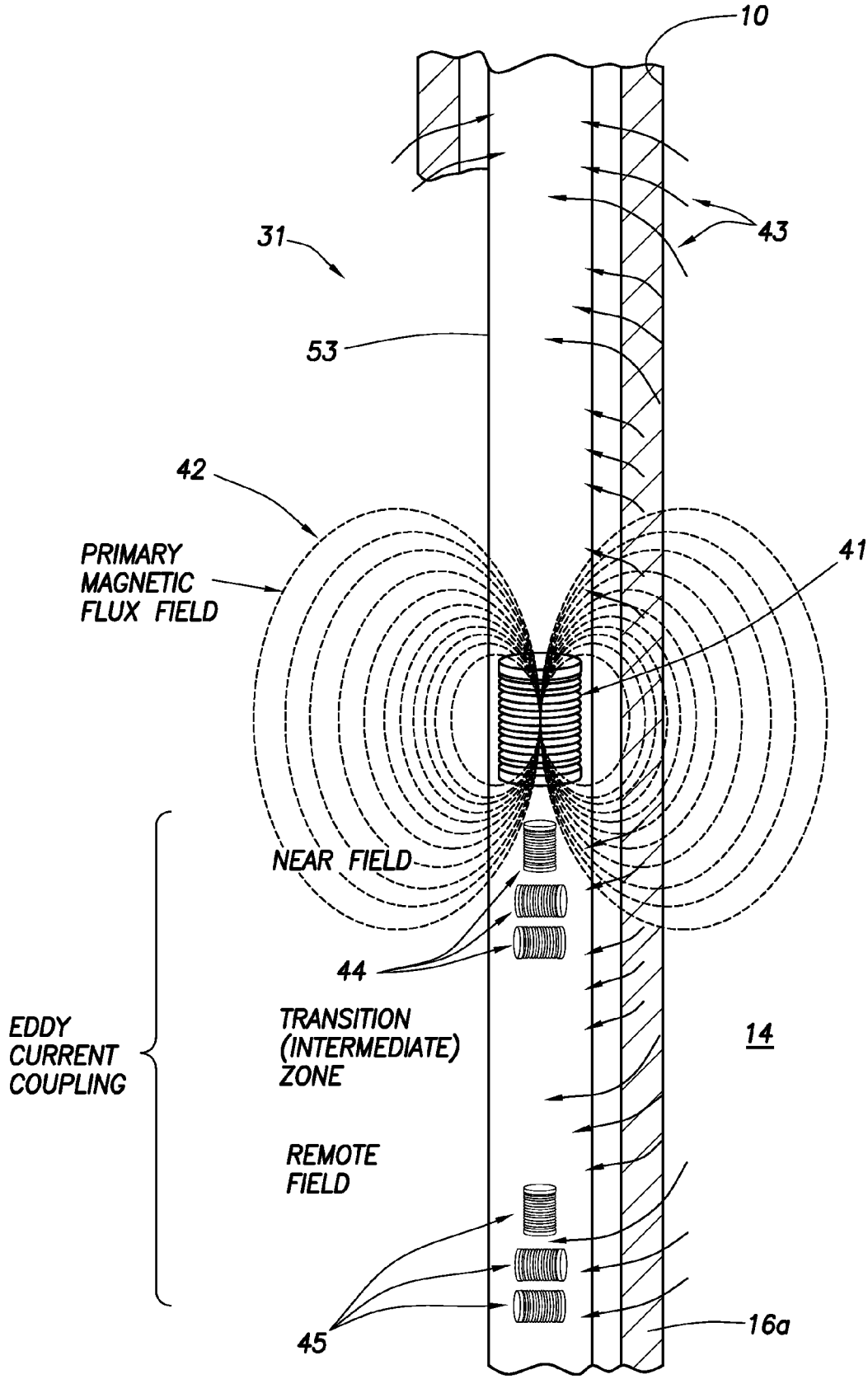
FIG. 10 is a sectional and schematic view of an electromagnetic or induction logging sonde within a section of tubing or casing.

Turning to FIGS. 7A-7B and 10, detection of casing collars 27 and tubing collars 28 in low or even non-magnetic pipe using a focused electromagnetic or induction sonde 31 is disclosed. The principle of operation based upon eddy currents as discussed in greater detail below in connection with FIG. 10, allows detecting features such as thickness changes in all metallic pipe such as casing 16 or tubing 12 regardless if ferrous or non-ferrous. As a result, the induction tool 31 can be used for detecting collars 27, 28 in all metallic pipe, and by adjusting the depth of investigation via operating frequency, the induction tool 31 can be used to distinguish large casing collars 27 from smaller tubing collars 28, and therefore be used for depth control.

When low or non-magnetic tubing 12 is used for example, conventional collar locators often detect collars 27 in the casing 16 as well as the tubing collars 28. This can be a source of confusion for depth control. It is therefore beneficial to detect only the collars 28 in the tubing 12 and ignore the collars 27 in the casing 16. Alternatively, and since the induction tool 31 can be used to discriminate between both types of collars 27, 28, the log presentation can show both in different colors and or different locations on the log. Casing centralizers may be also be detected using the tool 31. Also, using an electromagnetic or induction sonde 31, lateral or sidetrack windows can readily be detected and thus allow orienting a re-entry device such as a reentry nose 32 shown in FIG. 8. The induction tool 31 can also be used for precise axial positioning of a perforation gun 25. For example, when shooting across a pipe joint with a split-shot cutter, it is critical to position the cutter across the joint. Because the induction tool 31 can detect the pipe joint 27, 28 with precision, the extremities or edges of a feature (e.g., collars), depth control and positioning with respect to features can be made with as much precision as the conveying measurement system.

An induction tool 31 can also be used to determine a stuck point for drill pipe, casing or tubing. As studies have shown electrical and magnetic properties of metals change as a function of stress (e.g., the Barkhausen effect). By monitoring the magnetic permeability, it is possible to detect changes in elastic stress and the corresponding locations in the borehole and therefore calculate the stuck point of the pipe. Changes in stress in free pipe for example, will be seen as responses to tensile and torsional loading from surface. A significantly different degree of change is seen (including no change) below the point where the pipe is stuck. The forces basically by-pass the pipe below the stuck point and are coupled to the fixed point in the well (e.g., formation, another pipe, or mud cake). Because of the high resolution in measuring changes in eddy-current, this tool can detect changes in permeability, which affect the eddy-current coupling, and thus mechanical loading of pipe. An induction tool 31 can also be used for detecting flaws of significant magnitudes. Such anomalies include breaks, partial collapses, perforations, significant cracks, and the like. The accuracy of this tool increases inversely with gap between the tool sensors and the pipe. That is, as the greater the gap, the lower the sensitivity and accuracy.

Because the induction tool 31 can detect anomalies of certain magnitudes, it can be used to confirm perforations in pipe. Not only the presence of perforations, but their radial orientation as well. The induction tool 31 can confirm not only that a gun has fired or detonated, but that it has actually perforated the pipe. If the tool gap between tool 31 and pipe 12, 16 is close enough, it is feasible to determine the approximate size or diameter of entrance hole of the perforation. This may be highly beneficial when trouble shooting the production of a well or when questions regarding the quality of perforations arise.

Because the shot density of guns is limited, particularly with small diameter guns, it is often necessary to re-perforate the same interval. In these situations, random orientation of shots can produce overlapping shots thereby not effectively increasing the density. Because the induction tool 31 can detect the orientation of perforations, and because it can orient guns 25, re-perforation can be done in a controlled fashion so new perforations are placed as desired with respect to previous perforations. To facilitate the orienting of subsequent perforations, one perforation (e.g., the top shot), can be made to be the "marker" perforation and be used as the positioning reference. The "marker" perforation can be made to be more distinguishable by having unique spacing to the others, or by lacing it with a radioactive material or any other material that can be detected by one or more of the imaging sondes disclosed herein (Induction or Electromagnetic-based, Magnetometer-based, Nuclear-based, etc).

An induction tool 31 can also be used for real-time shot detection and any transverse movement of the perforating gun 25. It is not always possible to detect gun detonation at surface via shock reflections on the cable. Using electrical changes in the detonator circuit is likewise unreliable, and at best can only indicate that the detonator has fired. The gun 25 itself may have misfired. In these cases, it is good to know that a "live" gun is being brought back to surface. Including an induction tool 31 in the tool string 40 (FIG. 8) with a perforation gun 25 can provide reliable real-time shot detection benefit because the induction tool 31 produces a signal when transverse movement occurs.

Turning to FIG. 10, the induction-based sonde uses eddy current field measurements as its fundamental principle. An electromagnetic excitation field is propagated inside the pipe by an exciter coil and one or more sensors pick up the resulting eddy fields. Specifically, an alternating electric current is applied to a solenoid-type coil called exciter coil 41. The current in the coil 41 produces and propagates a primary electromagnetic flux field 42 along the coil (i.e., a dipole moment). The field 42 propagates radially into and axially along the pipe wall 16*a* as shown in FIG. 10. A resulting secondary current loop or eddy current 43 is induced into the pipe 16*a*. As the eddy current 43 travels through the pipe wall 16*a*, secondary fields are propagated. The electromagnetic sensor arrays (e.g., receiver or detector coils, magnetic sensors, etc.), one of which is shown as a near sensor array 44 and another as a far sensor array 45, pick up the secondary or eddy fields 42 and produce corresponding signals for processing.

The sensors of the arrays 44, 45 are focused thus have maximum sensitivity to the eddy fields 43 corresponding to their preferential orientation and position. A unique measurement is therefore made for every radial orientation of the tool 31. As the tool 31 is rotated via a motorized section 32 as shown in FIGS. 6 and 8, a composite image of the borehole 10 and surrounding formation 14 can be made.

The eddy fields 43 travel in two principal coupling paths: direct and indirect. The field 43 in the direct path decays rapidly (exponentially) because of circumferential eddy currents induced in the pipe wall 16*a*. The field 43 in the indirect coupling likewise decays exponentially, but at a much lower rate. This phenomenon is due to the phase difference for the two field paths (normally >90°) after approximately one coil diameter.

The eddy current coupling can be divided into three fields including a near eddy field proximate to the exciter coil 41 and encircling the exciter coil 41, a remote eddy field spaced away from the coil 41 and near the remote sensor array 45, and an intermediate field disposed between the near and remote fields. The near field, also referred to as the direct field, corresponds to a shallow depth (skin) of the pipe wall 16*a* (ID). At a certain axial distance away from the coil, typically greater than 3-pipe diameters the dominating remote or indirect eddy field corresponds to the exterior portion of the pipe wall 16*a*. In the remote region, the field lines behave quite differently as they are directed away from the coil 41. The remote field includes fields, which have traveled along the OD of the pipe 16*a*, exited the pipe 16*a* and re-entered the pipe 16*a*.

Anomalies or flaws including features or geometries in the ID or OD of the pipe 16*a* will cause changes in the amplitude and phase of the received signals and can therefore be readily detected by the tool 31. Tool response in the form of received signal magnitude, phase, shape, etc. can also be "calibrated" so that it is possible to determine the geometry anomalies or features based on calibrated responses for given pipe configuration. Adjacent completion strings and other well components external to the pipe that the tool is in can likewise affect the magnetic coupling and thus cause changes (e.g., amplitude and phase) in the received signal. Again, because the receiver sensors are focused, it is possible to survey or inspect the borehole circumferentially. As the sonde 31 is rotated by the motorized section 32 of the tool string 40, a scan or compilation of unique signals is made.

The received signal is affected by the characteristics (e.g., metallurgical properties, geometries, etc.) and proximities of the external components. A single adjacent completion cemented in open hole for example, see FIGS. 1A and 1B, will have maximum effect on the signal in that direction, and will have its greatest effect at the point of closest proximity. It is therefore readily possible to make precise orientations based upon the induction log.

In FIG. 10, a single exciter coil 41 is shown, but in another embodiment with increased resolution, especially for pipe inspection, a dual exciter coil can be used. In the dual exciter coil configuration, the excitation is provided by a set of two identical coils 41, connected in opposition, or with EM field flows in opposite direction with respect to each other. The receiver sensors or sensor arrays 44, 45 are configured differentially so only the difference between the two received signals is amplified or processed. This technique eliminates common-mode problems and focuses on the difference between the input signals at their respective points. For the applications addressed herein, a solenoid-type coil 41 construction as shown in FIG. 10 is practical. Other coil constructions (e.g., face or planar, cup, etc) may be used for propagating the excitation field 42 in a particular direction. The coil 41 may be oriented axially as shown in FIG. 10 or radially. The coil 41 may include a ferromagnetic core for higher inductance or the coil 41 may be constructed without a core.

The operating frequency is typically low (below 200 Hz) for using remote eddy field detection. However, the optimum frequency is a function of several factors (e.g., type and size of pipe, configuration in the borehole, desired depth of investigation, etc).

In a given pipe having a particular wall thickness and magnetic permeability, the depth of penetration (δ), by the induced eddy current also called skin depth or standard depth of penetration, becomes largely a function of the frequency of the EM field or the exciter coil 41. The penetration is generally expressed by the following simplified equation:

$$\delta=1/\sqrt{(\pi f\mu\sigma)},$$

where δ=standard depth of penetration, f=field frequency in Hertz (cycles per second), μ=magnetic permeability ~$4\times10^{-7}$ (for non-magnetic material), and σ=electrical conductivity in mho/m.

Figure 11:
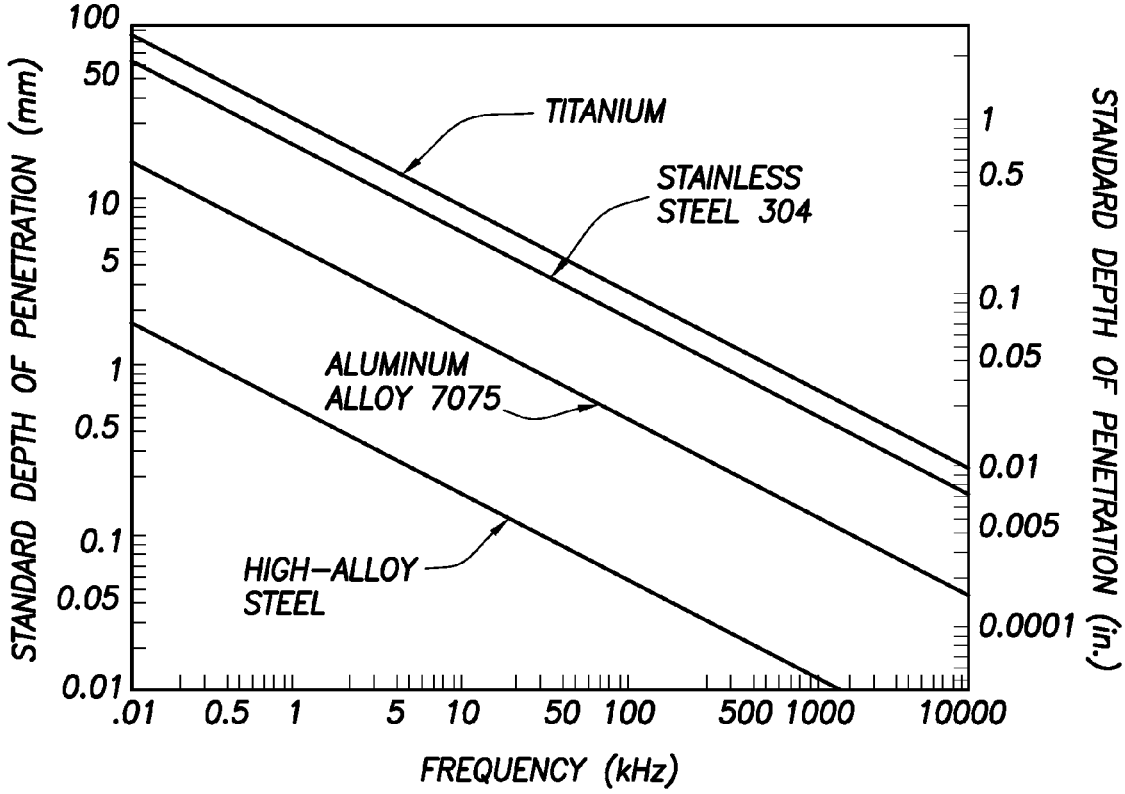
FIG. 11 graphically illustrates eddy current depth of penetration as a function of frequency for various casing materials including a high alloy steel, an aluminum alloy, a stainless steel and titanium.

As the equation above shows, metallurgical properties of the pipe, especially σ and μ, play a significant role in the behavior of the eddy currents and eddy fields. FIG. 11 graphically illustrates typical depths of penetration for various metals. In order to maintain a particular depth of penetration, and thus performance, as the pipe varies in thickness, or as the effective permeability μ and electrical conductivity σ varies, the EM frequency (f) must be adjusted accordingly. Under computer or micro-processor control, it is possible to precisely control the frequency and thus "select" the desired depth of penetration or distance to make measurements. Not only can the penetration depth be controlled with frequency adjustment, adjusting the frequency is an effective means to compensate for environmental effects. There is an optimum set of operating parameters for every well configuration and condition. In other embodiments, however, the operating frequency of the exciter coil 41 may be fixed based upon expected downhole conditions. In another embodiment, the frequency is computer controlled to compensate for environmental changes in the wellbore and or changes in well construction, or for simply obtaining an image based on frequency-spectrum.

The microprocessor or digital signal processor (DSP) preferably uses an automatic frequency control (AFC) algorithm to find the optimum operating frequency based on feedback from the signals received. Any number of closed-loop algorithms may be used for the AFC and thus to gain the best performance, and to select various types of measurements or depths of investigation. In another embodiment, the DSP simply sweeps the entire frequency range starting from say below 10 Hz to several thousand Hz. This allows composing an image as a function of frequency response. In yet another embodiment, the DSP also controls the excitation amplitude, shape (e.g., sine wave, square wave, etc), and whether continuous or pulsed, or sweeps through all of the above. In this way, the highest sensitivity can be obtained for various conditions e.g., pipe sizes, thickness, metallurgical properties, conditions, etc. In another embodiment, the excitation field is left un-activated and the focused sensors are in "passive mode." This mode allows surveying and orienting as a function of external field.

The focused detection sensors 44, 45 may be of the coil type including, but not limited to, miniature solenoid coils, spot coil or face coil, cup coil, pan-cake coil, segmented toroidal coil, etc. Magnetic sensors 44, 45 may provide better performance in low frequencies where coil performance suffers. Magnetic sensors 44, 45 may also provide for a very compact design as some magnetic sensors are very small (~0.3×0.3×0.1 inches). The small size of magnetic sensors allows placing sensors in precise locations and orientation to optimize measurements. Another significant advantage to magnetic sensors is the "direct sensing" without becoming part of the magnetic circuit. Some magnetic sensors include but not limited to Hall-effect, silicon based sensors (e.g., anisotropic magneto resistive (AMR)), giant magneto resistive (GMR)), magneto resistive, superconducting quantum interference device (SQUID), search-coil, magnetic flux-gate, magneto-inductive, etc.

In one embodiment, a single coil/sensor 45 may be located in the region optimized for sensing the far or extreme-far field eddy current signal. The sensor 45 orientation may also be optimized to detect the axial or radial field, including decentering the sensor(s) towards the OD of the tool and in accordance to the tool's reference point. In another embodiment, similar sensors 44, 45 may be placed in strategic locations along the axial length of the sonde 31 so as to pick up the fields in the near field and the far field. In another embodiment, arrays of sensors 44, 45 are constructed so as to cover bi-axially (x & z), or tri-axially (x, y, & z) the near-field and extend in length to the far or extreme-far field as shown in FIG. 10. This allows maximum coverage of all fields. Bi-axial sensing may come in useful when the eddy field in the axial direction is more dominant than the radial direction or have better focus. Tri-axial (three-dimensional) sensing allows additional flexibility for such things as confirming measurements, comparative or computing in ratio-metric mode, triangulation measurements, etc.

In another embodiment, and for logging in the axial direction (depth-logging), a set of identical coils/sensors 44, 45 is located at equal distance (normally very close proximity), from the exciter coil 41, on each side. These coils/sensors 44, 45 are configured differentially (e.g., to differential instrumentation amplifier), and magnetically balanced. That is, their differential output is null or zero when their magnetic field exposure is equal, similar to differential transformer. Any change in the pipe which results in a change in eddy current (e.g., geometry, magnetic permeability, conductivity, etc) will result in an imbalance of the induced field and thus the sensor output. As the tool 31 is moved axially in the well 10, features in the pipe 16*a* such as pipe joints, including flush pipe joints, collars, perforations, nipples, etc. can be readily detected. Because this principle works in all metallic pipe, regardless of its magnetic permeability, it has major applications in depth control where non-magnetic pipe (e.g., Hastelloy) is used and conventional collar locators do not work.

In another embodiment, some of the coils/sensors 44, 45 may be computer-configurable. That is, depending on the application (e.g., axial logging or radial logging (via motorized section 32)), the DSP of the tool 31 can connect the sensors 44, 45 accordingly via relays (solid-state or electromechanical).

In another embodiment, the sensor arrays 44, 45 of the induction tool 31 may be made with enough radial resolution that they can scan or image the borehole radially without requiring rotation. The primary application would only include surveying, as real-time orientation is not practical without a motorized section 32. In another embodiment, the detection section of the tool is extended so that it is brought in close proximity to the casing or tubing. This can be accomplished using decentralizers, extended arms or pads which carry the energizing and sensor coils 44, 45.

Shielding the sensors 44, 45 improves focus. A shield can made of material with high magnetic permeability (μ), such as mu-metal or ferrite, or it may be made of low magnetic permeability μ such as copper.

Because anomalies and features in the pipe will cause changes in the amplitude and phase of the received signals, it is important to measure both. Detection of other well components exterior to the pipe will do the same and can therefore be readily detected. Measuring phase can also be used for example, to ensure that the primary field from the exciter coil 41 is not being measured inadvertently. Operating (analyzing data) in the frequency domain versus time domain may provide additional useful information.

The quality and accuracy of measurements can be improved by "normalizing" the in situ measurement. That is, as stated previously, electromagnetic based measurements tend to be affected by changes in the surrounding magnetic environment. That environment includes all metallic components that are within the magnetic field. This can often work against us because in most cases, we maximum radius of investigation. As the environment gets increasingly cluttered, the dynamic response is decreased because of the loss in "free magnetic field." These effects may be minimized by: use of computer-controlled excitation to optimize the measurement (sensor response) for that particular magnetic environment; normalizing the measurement via computational algorithm or data processing; and normalizing the measurement to the known sections of the borehole. As the tool surveys or images the borehole, the well components or features may only be seen as measurement excursions. The dynamic response is improved by using the measurement in the opposite points as a reference. Other scaling factors and filters may be used to further improve the dynamic response and thus the measurement.

To avoid coupling the exciter field into the sensors or to cancel its effects, a few schemes include, but are not limited to: rotating the sensors so they are not in the same axis as the exciter coil; and measuring and canceling the corresponding in-phase signal. The remaining out of phase portion of the signal can therefore be processed. A number of schemes may be employed to measure the in-phase signal.

A "reference" sensor positioned in the same axis as the exciter coil may be used in close proximity to the sensor. The reference signal may then be used to establish a filtering function or discriminating/differentiating function via circuitry or via digital filter (software algorithm). Similarly, a scheme may be employed via circuitry or via signal acquisition algorithm which uses the timing of the exciter coil signal to discriminate only signal that are out of phase (phase-sensitive) and may include detection of zero-crossing of the exciter signal.

Figure 12:
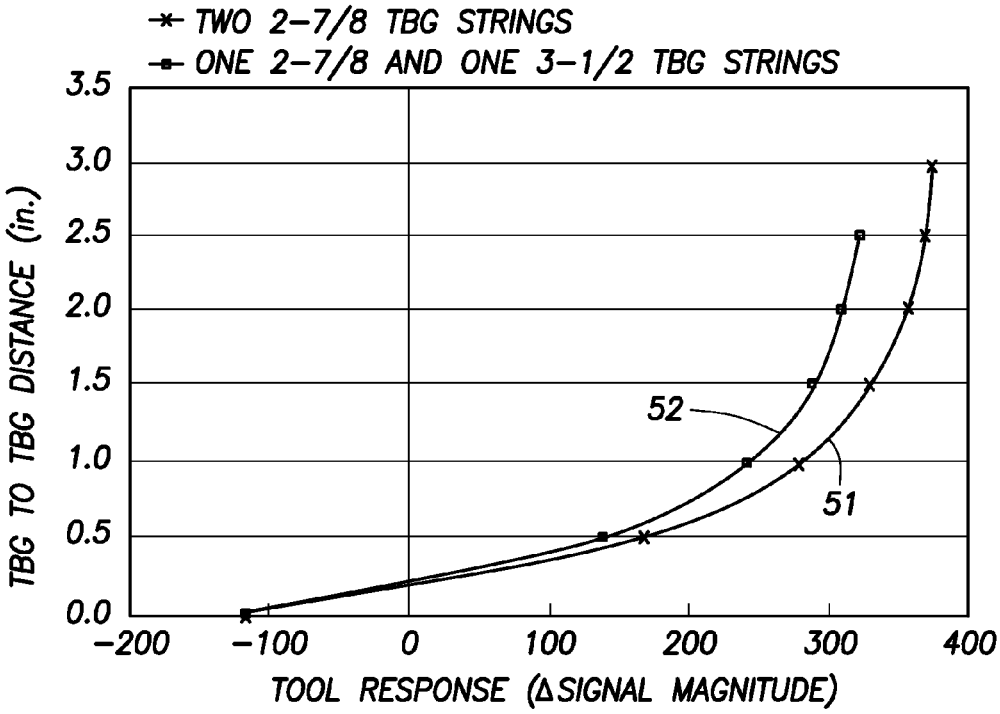
FIG. 12 graphically illustrates an induction tool response as a function of tubing spacing for a pair of 2⅞" tubing strings and for one 2⅞" tubing and one 3½" tubing.

As mentioned previously, it is not only possible to detect the presence and direction of well components external to the pipe the tool is in, but also the proximity (distance) to those components. This requires proper numerical modeling, response characterization of tool and sensor calibration. As can be seen FIG. 12, it is highly feasible to compute proximity based on previously established tool responses for various conditions. Two response tests were conducted. In the first test (curve 51), a set of two, 2⅞-inch tubing was used. The tool 31 was run in the "primary" tubing; the second (adjacent) tubing was gradually separated from the primary tubing while logging the tool response. As shown in FIG. 12, the response magnitude followed the displacement of the adjacent tubing. While this un-compensated response was not linear, it had a high degree of repeatability, in both directions of tubing displacement. Because there is a definitive and unique response output for every position of the tubing, it is possible to determine its proximity (relative location) based on the response.

The second response test (curve 52) was identical except this time a 3½-inch tubing was used as the second (adjacent) tubing. Again, highly repeatable results were obtained albeit with a different response curve. The difference in response is due to the difference in magnetic environment caused by the larger tubing.

In one embodiment, a non-metallic housing 53 for the induction sonde 31 is used. The non-metallic housing allows maximizing the EM (electromagnetic) field propagation and thus the effectiveness. The housing 53 should include a pressure compensation or equalization system in order for the non-metallic housing to survive the well pressure. A number of high-strength composite materials can be used for this purpose e.g., high-strength, fiber reinforced composite. In another embodiment, the induction sonde 31 can be covered with a thin-wall metallic housing 53 having a wall thickness for example of 0.125 inches. Again, pressure compensation (e.g., piston and spring, or bellows system, etc) is used in order to prevent the thin wall housing from collapsing under well pressure. By using a thin walled housing, attenuation of the magnetic field is minimized. The use of low or non-magnetic metals such as MP-35, 304 stainless, titanium, aluminum alloy, copper alloy (e.g., beryllium copper), may be used to further reduce the attenuation of the EM field. As can be seen form FIG. 12, these non-magnetic (non-ferrous) metals have lower EM induction values and therefore result in lower induced eddy currents and more signal propagation beyond the sonde 31.

In another embodiment, the pressure housing 53 surrounding the EM system is made of metallic material for strength, however, the electrical properties of that material are low magnetic permeability (low or non-magnetic), and low conductivity (e.g., titanium). This combination minimizes attenuation of the excitation field due to the losses by the effects of the "single-turn secondary" that the housing has on the exciter coil. As such, more effective penetration of eddy currents in well completion pipes is accomplished.

Focused Nuclear Sondes

The main application for a focused nuclear sonde is to detect the presence and direction of metallic well components external to the pipe, casing or tubing that the tool is in, and to orient devices either away from or towards the detected component. Many, but not all, of the applications of the inductive-based sonde 31 apply to the focused nuclear sonde. The focused nuclear tool simply does not have, for example, the resolution to detect and image features and anomalies in the pipe like the induction sonde 31.

In an embodiment, a highly sensitive and focused nuclear detector is used for radially or circumferentially scanning the borehole 10 and indicating the presence of other tubing strings 12 or casings 16. In this case, the formation is the radiological source and the type of radiation is natural gamma ray radiation. Because steel attenuates or partially blocks the gamma ray emission from reaching the detector, a borehole may be "scanned" by a focused sensor such as a gamma-ray detector to measure the directional levels of emission. The adjacent tubing strings or casings will be indicated by the lower levels of radioactive detection in alignment with their corresponding radial direction. In some cases, depending on the level of radiological emissions from the formation, several scans or rotations may be necessary in order to obtain enough statistical data to form a quality image. A variety of algorithms may be used in order to compose a suitable image.

The aperture or window of the detector will require being wide enough to allow enough radioactive emission energy to enter, however, will also need to be narrow enough to allow adequate radial resolution. The aperture angle may range from about 45° to about 90°. Numerous methods may be used for focusing the detector. Some include back shielding the detector itself with a high-density material (e.g., tungsten (W), lead (Pb), fully depleted uranium (U), etc).

Alternatively, a cover sleeve may be placed over the detector section inside the tool housing. The sleeve would include a slotted opening (window) to allow the radioactive emissions to enter the detector. The "detector window" may also be integrated into the pressure housing for example by making the window portion of the housing of a material having lower attenuation of gamma rays compared to the rest of the housing. The windowed sleeve may alternatively be made to slip-in or slipover the pressure housing in the vicinity of the detector. Other means may also be used for example that would allow the shielding or focusing to be controlled electronically via electrically charged guarding.

In another embodiment, the performance may be greatly enhanced by introducing a radioactive source into the adjacent tubing or casing in the axial proximity of the tool. This may be necessary when the natural gamma-ray emissions of the formation are low. A source such as cesium-137 (137Cs), which emits primarily gamma rays, may be used for this purpose. Alternatively, iridium-192 (192Ir) or cobalt-60 (60Co) may be used. Even a small radioactive source, e.g., PIP tag (precision identified perforation tag) may be run in on a simple tool. The radioactive source may also be conveyed by slickline. Once the orientation of the adjacent tubing is determined, the radioactive source is retrieved. Multiple intervals may be "mapped" on a single trip.

Alternatively, a small radioactive source, e.g., PIP tag (precision identified perforation tag) may be attached to the well component such as a tubing string, casing, control cables, etc, prior to being run into the well. As the tool radially scans the borehole, an increase in radioactive emission will be detected when the focused detector comes in proximity and alignment with the well component containing the radioactive tag. Also, a radioactive tracer fluid may also be circulated or spotted in the tubing or conduit to be protected or targeted.

In another embodiment, a focused, nuclear based, elemental spectroscopy type tool may accomplish the detection of external components. In this embodiment, the nuclear source such as americium beryllium (AmBe), which is primarily an emitter of neutrons, is carried by the tool. As the focused tool radially scans the borehole, a change in the level at which iron (Fe) escapes for example, will be detected in the direction of the external well component (e.g., adjacent pipe).

Focused Acoustic Sondes

Because of the poor coupling of acoustic energy in gases (including air), an acoustic sonde finds primary applications in liquid filled wells. While detection of joints in non-metallic pipe (e.g., fiber-glass, other composite tubing) for depth control for example, is not possible with conventional CCLs or even with the previously mentioned induction or focused nuclear sondes, an acoustic sonde can readily detect joints of pipe via their sudden change in acoustic impedance. The reflected acoustic wave or echo in the joint will have a measurable difference in amplitude and phase. This is particularly detectable in portion of the echo, which corresponds to the far-field. The transducers placed with sufficient spacing from the transmitter will optimize measurement of this signal and thus increase performance for this application.

Figure 13C:
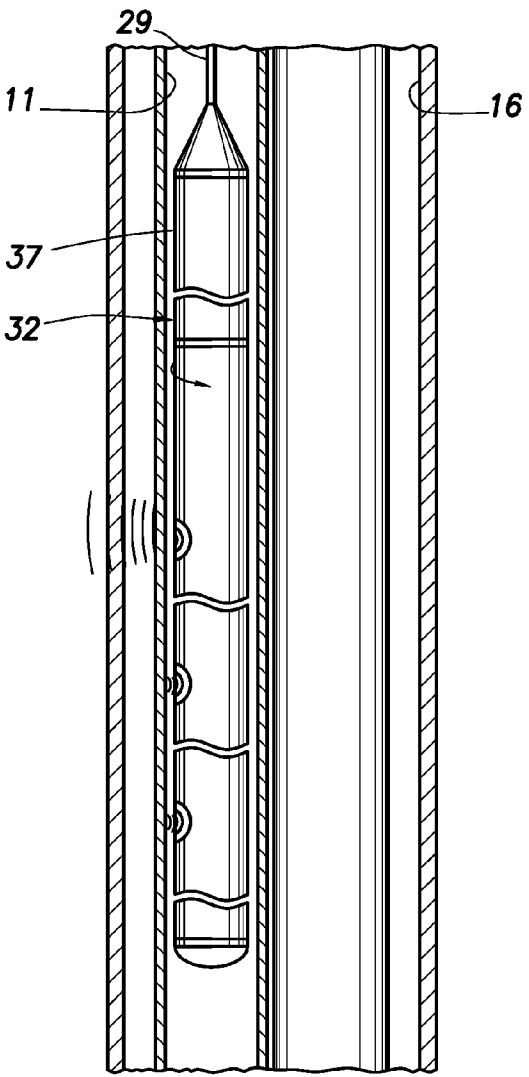
FIGS. 13A-13C are sectional views of a dual tubing string completion inside a casing with a logging tool in three different orientations.
Figure 13B:
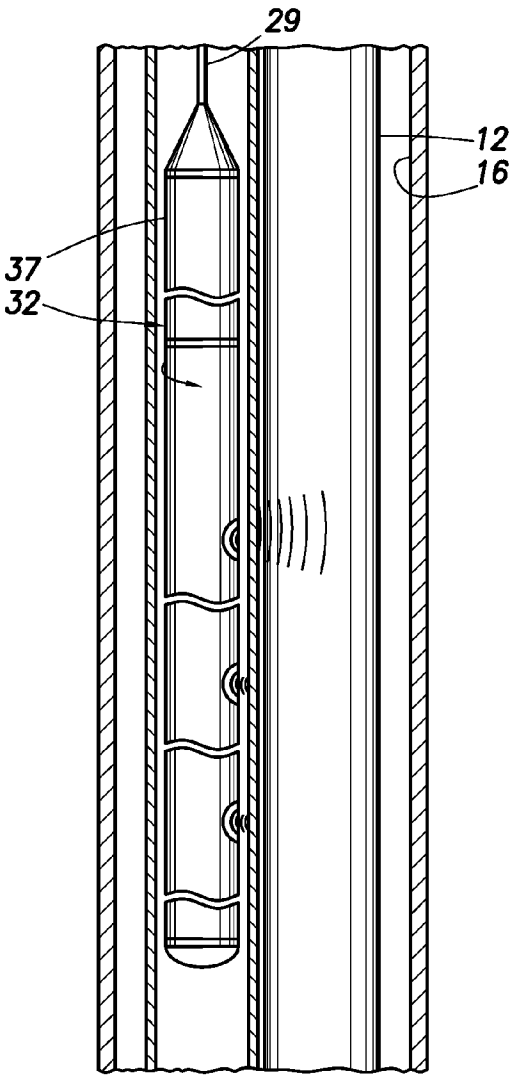
Figure 13A:
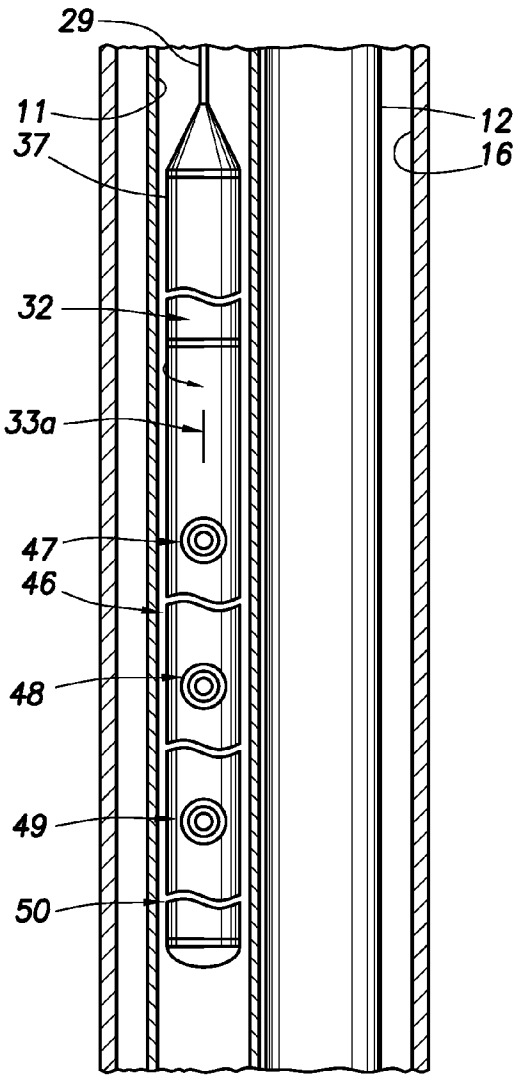
Figure 14:
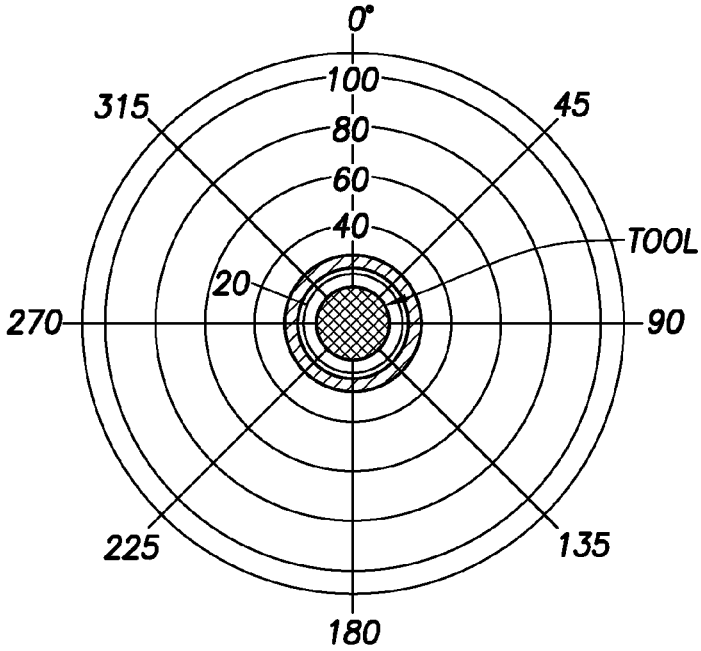
FIG. 14 is an initial pre-log sectional illustration of a production tubing and logging tool.
Figure 15:
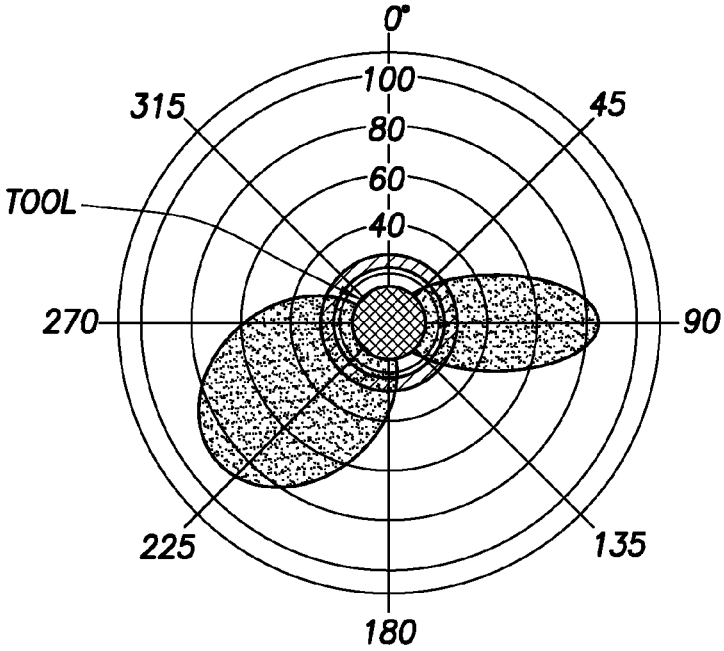
FIG. 15 is a real-time log indicating the proximity of two tubing strings and the position of the production tubing in which the logging tool is disposed with respect to the casing and formation, and FIG. 16 a composite image generated based on the data collected from the log shown in FIG. 15.

For example, referring to FIGS. 13A-13C, a telemetry sonde 37 is connected to a wireline 29 and a motor module 32 (the non-rotating centralizer is not shown). The motor module 32 rotates the acoustic sonde 46, which includes a transmitter 47 and multiple receivers 48, 49. The survey generated by the date collected from the acoustic sonde 46 is used to orient the downhole operational tool(s) 50 that are shown schematically.

External components, like the tubing 12 of FIGS. 13A-13C, that are in close proximity or even in contact with the primary tubing 11, as well as features in and around the tubing 11, tubing 12 and casing can be detected. Like a focused sonar, as the tool 46 rotates, the transmitter 47 and receivers 48, 49 are used to create an image based on acoustic echo, particularly the far-field portion.

Because of the quality in localized acoustic coupling between pipe and formation, it is possible to identify the point at which the pipe is stuck. It is feasible to determine this point by axially logging the well, however, applying tensile or torsional load to the pipe while logging improves the acoustic-coupling contrast and hence should provide better/different results for further confirmation. The acoustic coupling will not change below the stuck point and therefore no change in the log will be seen with or without tensile/tortional loading of the pipe from surface.

The section of stuck pipe can also be identified by radially scanning the pipe. The stuck side will have lower echo energy because of the strong coupling to the formation. The most of the induced elastic wave is essentially coupled from the pipe into the formation thus less reflective energy is received back into the tool. Conversely, the portion of pipe that that is not stuck to the formation reflects higher acoustic energy.

Because the acoustic receiver transducers can pick up a wide range of acoustic frequencies, the acoustic receivers can pick up acoustic energy produced by flowing fluids for purposes of leak detection.

Using an acoustic sonde, a directional perforator can be oriented to a channel or void in the cement sheath for the purpose of optimizing cement squeeze job. A key to the success of squeezing cement into a channel is to place perforations in close proximity to the channel. Otherwise, the new cement has to break down existing cement in order to flow into the channel. Because of the capability of the acoustic tool 46 to perform directional cement bond logging (CBL), it can re-find a channel and orient a squeeze gun into it.

The acoustic tool 46 is configured as a focused sonar. Acoustic energy is propagated radially into the pipe 11 or 16 by the transmitter 47 and the reflected (echo) energy is received by the receivers 48, 49 and processed. The receivers 48, 49 are focused so their signal corresponds primarily to a radial portion of the pipe 11. The reflected energy is analyzed for amplitude and transit time between transmission and echo reception. The transmitter 47 is computer controlled so its frequency is dynamically adjustable (e.g., from sonic to ultrasonic). The transmitter 47 may be turned off altogether and allow the tool 46 to operate in "listen" mode.

The borehole may be logged axially with the acoustic tool 46 or both axially and radially, when combined with the motorized module 32. In one embodiment, the tool 46 contains multiple transducers 48, 49 with various axial spacing to allow analyzing various depths of investigation. In another embodiment, the frequency is computer controlled so as to adjust depth of investigation and or to optimize measurement for various wellbore conditions. The transmitter 47 is an electromechanical device, which converts electrical energy to acoustic energy. Any number of technologies may be used including crystal, magnetostrictive, etc. Like the induction-based principle described above, the transmitter in this principle may be part of a "smart", closed-loop system. That is, the frequency and amplitude is adjusted per an algorithm which attempts to maintain a certain level response as indicated or measured by feedback from the sensor array. The output required to maintain that level response may then be used as the data.

In another embodiment, the transmitter 47 output (frequency and amplitude) is swept through a pre-determined range (sonic to ultrasonic). The resulting change in wavelength during the sweep, allows various depths of penetration and compensation for variations in pipe sizes, thickness, spacing between tool and pipe, etc. Certain frequencies will be more optimal than others for a given wellbore configuration. Because of the uncertainties in wellbore configurations, sweeping through a range of frequencies will help cover the spectrum.

Data Presentations

Figure 16:
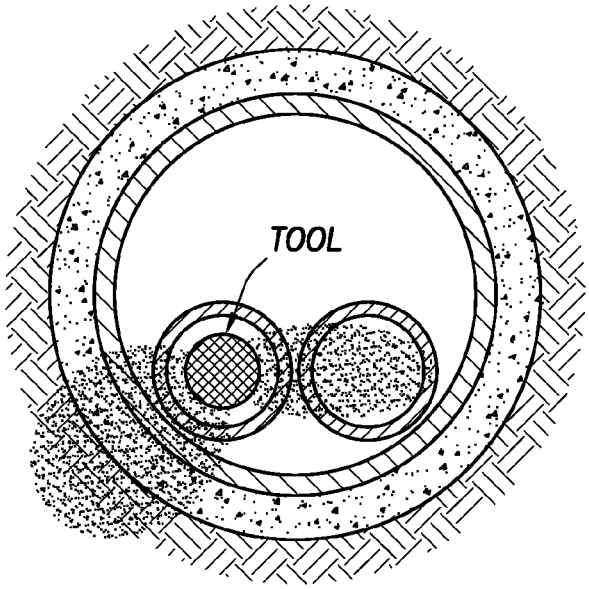
Figure 17:
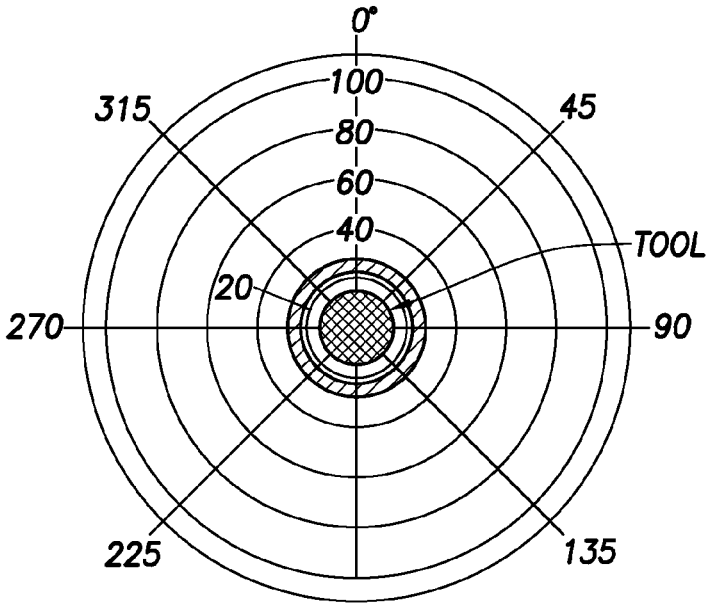
FIG. 17 is an initial pre-log sectional illustration of a production tubing and logging tool.
Figure 18:
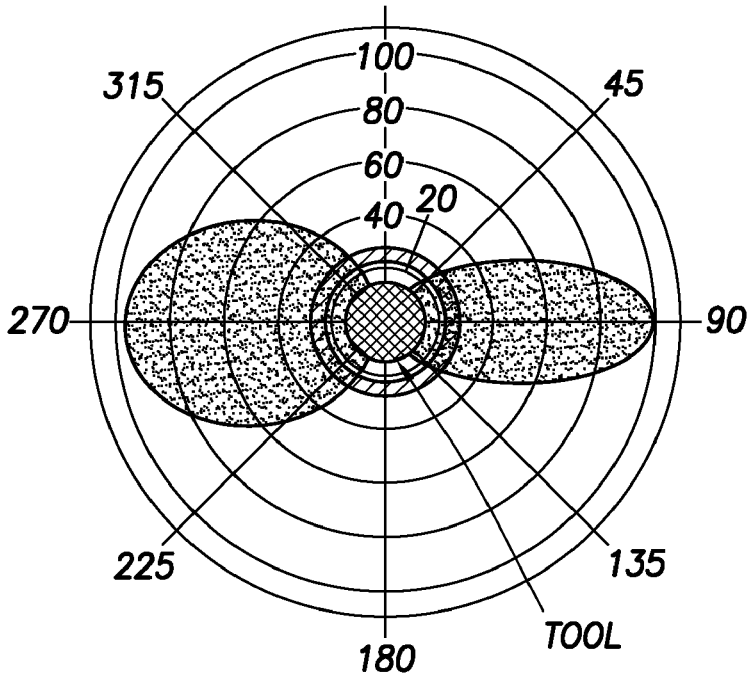
FIG. 18 is a real-time log indicating the proximity of two tubing strings and the position of the production tubing in which the logging tool is disposed with respect to the casing and formation.
Figure 19:
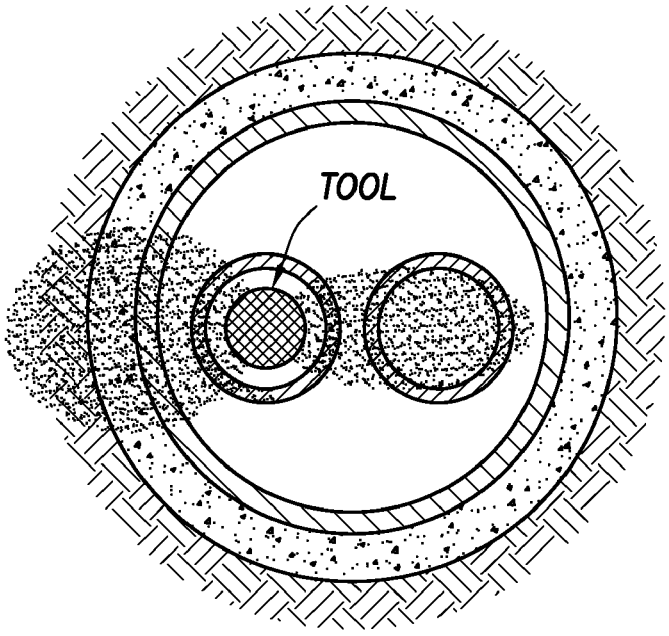
FIG. 19 is a composite image generated based on the data collected from the log shown in FIG. 18.

Referring to FIGS. 14-16 and 17-19, the data may be presented in a "radar" fashion. That is, in the same fashion that it is scanned. Data regarding wellbore conditions, well construction and pipe details will normally be entered by the user. This data is used primarily by computational routines for data treatment against previously established tool responses and characterization for similar conditions. In addition, this same data may be used by the computer to compose a cross-sectional image of the wellbore as shown in FIGS. 16 and 19. FIGS. 16 and 19 are based on data from the focused imaging tool and measurements from other associated tools.

In another embodiment, the data may be presented in an image of the wellbore versus depth (e.g., with the 360-degree circumference un-folded in one axis (e.g., x-axis), and the depth in the other axis (e.g., y-axis). In this case, the 0-deg or arbitrary start point on one side (e.g., left side), and the 359-degree on the opposite side (e.g., right side).

While the examples are essentially limited to radial surveys in a stationary mode using the motorized module, the disclosed tools can likewise be used for axial surveying or depth logging by simply not energizing the motorized module. Also, logging axially while rotating the tools for radial logging may be performed as well.

The radial survey logging operation and the positioning or orienting of the downhole operational devices can be performed simultaneously or sequentially. For example, when a gyroscope is used for orientation and azimuthal measurements in a perforation operation, it is necessary to separate the use of the gyroscope from the perforating to avoid damaging delicate and costly gyroscope module. Data from the gyroscope can be correlated with measurements from other more robust instruments such as magnetometers, inclinometers, etc. The subsequent orientation prior to perforating is then performed using the robust instruments and the correlated data.

When using tools carrying a nuclear source, it is typically not advisable to perform a "risky" operation with sources. Therefore, the orienting operation is performed separately as described above.

While only certain embodiments have been set forth, alternatives and modifications will be apparent from the above description to those skilled in the art. These and other alternatives are considered equivalents and within the spirit and scope of this disclosure and the appended claims.

What is claimed is:

1. A method of orienting a perforating gun in a borehole of a formation, comprising:

running a tool string into the borehole to a predetermined depth, the tool string comprising a motor module, the perforating gun, at least one centralizer disposed above the perforating gun, and an imaging device, wherein the imaging device is selected from a group consisting of a focused acoustic instrument, a focused thermal instrument and a focused flow measuring instrument;

imaging the borehole and the formation at the predetermined depth with the imaging device while rotating the imaging device about an axis of the tool string with the motor module to provide a radial survey of the borehole and the formation at the predetermined depth;

rotating the perforating gun about the axis of the tool string to a desired orientation with the motor module based on the radial survey; and actuating the perforating gun at the desired orientation;

wherein the at least one centralizer comprises a non-rotating centralizer disposed above the imaging device and a rotating centralizer disposed below the imaging device.

2. The method of claim 1 wherein the tool string further comprises a gyroscope and the method further comprises measuring an azimuth of the borehole with the gyroscope.

3. The method of claim 1 wherein the tool string further comprises a magnetometer device and the method further comprises measuring a magnetic anisotropy of the borehole with the magnetometer device.

4. The method of claim 3 wherein the magnetometer device comprises two sensors oriented at about a right angle with respect to each other.

5. An oriented tool string for use in a borehole, the tool string comprising:

a motor module;

a perforating gun;

at least two centralizers;

an imaging device disposed between the at least two centralizers selected from a group consisting a focused acoustic device, a focused thermal device and a focused flow measuring device;

the motor module capable of rotating the imaging device about an axis of the tool string to provide a radial survey of the borehole at a predetermined depth using data obtained from the imaging device; and the motor module rotating the perforating gun about the axis of the tool string to a desired orientation based on the radial survey.

6. The tool string of claim 5 further comprising a micro-electro-mechanical system (MEMS) device for measuring an azimuth of the borehole.

7. The tool string of claim 5 further comprising a magnetometer device for measuring a magnetic anisotropy of the borehole.

8. The tool string of claim 5 wherein the at least two centralizers comprise a non-rotating centralizer disposed above the motor module and a rotating centralizer disposed below the motor module.

9. The method of claim 1 further comprising the steps of:

determining an orientation of a defect in cement in an annular space between the borehole and a casing inserted therein using the acoustic imaging device; and orienting the perforating gun toward the defect.

10. The method of claim 1 further comprising determining an orientation of fluid entering the borehole from perforations in a casing disposed in the borehole using at least one of the focused thermal imaging device and the focused flow measuring device, and orienting the perforating gun toward the entering fluid.

11. The method of claim 1, wherein the tool string remains the borehole between the step of imaging the borehole at the predetermined depth and the step of actuating the perforating gun at the desired orientation.

12. A method of orienting a downhole operational device in a borehole of a formation, comprising:

running a tool string into the borehole to a predetermined depth, the tool string comprising a motor module, the downhole operational device, a lower centralizer disposed above the downhole operational device, an upper centralizer, and an imaging device disposed between the lower centralizer and the upper centralizer, wherein the imaging device is selected from a group consisting of a focused acoustic instrument, a focused thermal instrument and a focused flow measuring instrument;

imaging the borehole and the formation at the predetermined depth with the imaging device while rotating the imaging device about an axis of the tool string with the motor module to provide a radial survey of the borehole and the formation at the predetermined depth;

rotating the downhole operational device about the axis of the tool string to a desired orientation with the motor module based on the radial survey; and actuating the downhole operational device at the desired orientation.

13. The method of claim 1, further comprising the steps of:

placing a magnetic material proximate a well component at a given depth of the borehole;

deploying a magnetometer into the borehole at the given depth; and rotating the magnetometer at the given depth to identify an azimuthal position of the magnetic material at the given depth, wherein the desired orientation is further based on the azimuthal position of the magnetic material at the given depth.

14. The method of claim 13, wherein the desired orientation is approximately azimuthally opposite from the azimuthal position of the magnetic material at the given depth.

15. The method of claim 13, wherein the step of placing a magnetic material proximate a well component is performed prior to the step of running the tool string into the borehole.

16. The method of claim 13, wherein the step of placing a magnetic material proximate a well component comprises the step of attaching the magnetic material to a surface of casing prior to installation thereof in the borehole.

17. The method of claim 13, wherein the step of placing a magnetic material proximate a well component comprises the step of lowering the magnetic material into the borehole to a depth and position proximate the well component.

18. The method of claim 17 further comprising the steps of:

determining an orientation of a defect in cement in an annular space between the borehole and a casing inserted therein using the acoustic imaging device; and orienting the perforating gun toward the defect.

* * * * *